US009950401B2

(12) United States Patent
Persson

(10) Patent No.: US 9,950,401 B2
(45) Date of Patent: Apr. 24, 2018

(54) JIG MEANS FOR A GRINDING MACHINE AND A GRINDING MACHINE COMPRISING THE JIG MEANS

(71) Applicant: Tormek AB, Lindesberg (SE)

(72) Inventor: Håkan Persson, Lindesberg (SE)

(73) Assignee: Tormek AB, Lindesberg (SE)

( * ) Notice: Subject to any disclaimer, the term of this patent is extended or adjusted under 35 U.S.C. 154(b) by 88 days.

(21) Appl. No.: 14/533,444

(22) Filed: Nov. 5, 2014

(65) Prior Publication Data

US 2015/0165582 A1 Jun. 18, 2015

(30) Foreign Application Priority Data

Dec. 12, 2013 (SE) ..... 1351483-1

(51) Int. Cl.

| | |
|---|---|
| ***B24B 3/54*** | (2006.01) |
| ***B24B 41/06*** | (2012.01) |
| ***B24B 27/02*** | (2006.01) |

(52) U.S. Cl.

CPC ..... *B24B 3/54* (2013.01); *B24B 27/02* (2013.01); *B24B 41/066* (2013.01)

(58) Field of Classification Search

CPC B24B 41/06; B24B 3/54; B24B 3/365; B24B 3/00; B24B 27/02; B24B 41/066; B24B 3/36

See application file for complete search history.

(56) References Cited

U.S. PATENT DOCUMENTS

| | | | | |
|---|---|---|---|---|
| 2,562,618 | A * | 7/1951 | Keller | B24B 3/54 451/241 |
| 2,753,666 | A * | 7/1956 | Sasse | B24B 3/38 451/224 |
| 3,254,456 | A * | 6/1966 | Clark | B24D 15/065 451/555 |
| 3,501,871 | A * | 3/1970 | Anderson | B24B 3/36 451/383 |
| 5,390,431 | A | 2/1995 | Friel | |

(Continued)

FOREIGN PATENT DOCUMENTS

| | | |
|---|---|---|
| SE | 8306325 | 5/1985 |
| WO | WO 97/33717 | 9/1997 |
| WO | WO 99/56915 | 11/1999 |

OTHER PUBLICATIONS

"Injected Plastic parts c3." Mar. 5, 2013. InjectionMoldedPlasticParts.com. Date of Access Nov. 16, 2016. <http://www.injectionmoldedplasticsparts.com/injectionmouldingABS.html>.*

(Continued)

*Primary Examiner* — Christopher M Koehler
*Assistant Examiner* — Joel Crandall
(74) *Attorney, Agent, or Firm* — Merchant & Gould P.C.

(57) ABSTRACT

A grinding machine has a rotatable grindstone (1) and a support (12), which is generally parallel to an axis of the grindstone. Jig means (1-8) are provided for bringing a knife blade (15) to be sharpened into controlled engagement with the grindstone (1). A jig arm (1) is provided with attachment means (2, 3) for its fixed attachment to the support (12) in a proper position for the sharpening of the knife blade (15) and—at a distance from the attachment means—with resilient holding means (1') for the knife blade (15).

20 Claims, 7 Drawing Sheets

(56) References Cited

U.S. PATENT DOCUMENTS

| | | | | |
|---|---|---|---|---|
| 2005/0090184 | A1* | 4/2005 | Zhang | B24B 41/06 451/5 |
| 2006/0258271 | A1* | 11/2006 | Naples | B24B 41/066 451/45 |
| 2007/0249268 | A1* | 10/2007 | Swartz | B24B 41/06 451/349 |
| 2013/0095736 | A1* | 4/2013 | Masalin | B24B 3/54 451/545 |

OTHER PUBLICATIONS

Communication from European Patent Office for corresponding EP application No. 14191837.5 dated Nov. 2, 2015 (4 pages).
European Search Report for corresponding application No. 14191837 dated Apr. 20, 2015 (6 pages).
Swedish Search Report for corresponding application No. 1351483-1 dated Jun. 12, 2014 (5 pages).

* cited by examiner

JIG MEANS FOR A GRINDING MACHINE AND A GRINDING MACHINE COMPRISING THE JIG MEANS

RELATED APPLICATIONS

This claims priority to Swedish Patent Application No. 1351483-1, entitled "JIG MEANS FOR A GRINDING MACHINE", filed Dec. 12, 2013, which is incorporated by reference herein in its entirety.

TECHNICAL FIELD

The present disclosure generally relates to jig means for a grinding machine. Also, the present disclosure presents a grinding machine comprising the jig means.

Embodiments of the present invention relate to a grinding machine with a rotatable grindstone and with a support, the support being generally parallel to the axis of the grindstone, and jig means being provided for bringing a knife blade to be sharpened into controlled engagement with the grindstone. Embodiments of the invention also relates to the jig means themselves.

BACKGROUND

There are many known examples of jigs, or jig means, intended for knife sharpening in a grinding machine, especially for non-professional use. However, in many cases the obtained result with regard to the evenness of the sharpening and the edge angle is dependent on the skill of the user. In other cases, where the skill needed by the user for obtaining a good sharpening result is lower, the knife may have to be attached in the jig in a more or less complicated manner, which may in turn make the use awkward.

SUMMARY

It is in view of the above considerations and others that the various embodiments of the present invention have been made.

A general object is therefore to attain a jig, or jig means, in which a knife blade can be easily mounted. Advantageously, the position of the jig in relation to the grindstone should still be controllable. Also, the use and construction of the jig should preferably be as simple as possible. This object and other objects are addressed by the appended claims.

According to a first aspect, jig means for bringing a knife blade to be sharpened into controlled engagement with a grindstone of a grinding machine are provided. The grinding machine is of a type comprising a rotatable grindstone and a support, wherein the support is generally parallel to an axis of the grindstone. In other words, the support is positioned generally in parallel to a rotational axis of the grindstone. The jig means comprises a jig arm which is provided with attachment means for its fixed attachment to the support in a proper position for the sharpening of the knife blade. At a distance from the attachment means, the jig arm is also provided with resilient holding means for the knife blade.

Advantageously, the attachment means are a hole of the jig arm and a threaded pin with a knob positioned at the hole.

In one embodiment, the resilient holding means are a clamp integral with and generally parallel to the jig arm. Preferably, but not necessarily, the jig arm is injection moulded in Acrylonitrile Butadiene Styrene (ABS) plastic. Other materials and manufacturing techniques are of course also conceivable. A knife blade may easily be inserted sideways into the clamp and be supported by the jig arm area inside the clamp.

The jig arm may be provided with a projection having thereon a scale with desired edge angles for a knife blade to be sharpened. In one embodiment, and in order to obtain a desired edge angle at the knife sharpening and a correct (or accurate) position of the jig arm in relation to a grindstone, a template is pivotally attached to said projection and has a pointer towards the scale, means being provided for locking the template to the projection, and the template being provided with two reference pins perpendicular thereto.

In another embodiment, the resilient holding means are a clamp which is generally parallel to the jig arm, wherein the clamp is made of a resilient material and the jig arm is made of a metal, or a metal alloy. For example, the clamp may be made of a plastic such as ABS plastic. For example, the jig arm may be made of Zinc, Aluminum, steel, brass or cast iron to name a few examples. Furthermore, it should be appreciated that the metal, or metal alloy, may be moulded.

For example, the jig arm may be provided with a scale with desired edge angles for a knife blade to be sharpened.

In some embodiments, the attachment means may additionally comprise a projection which is adapted to at least partly surround and generally abut against the support.

In some embodiments, the resilient holding means advantageously also comprises a waste material collecting means adapted to collect waste material from the knife blade during a sharpening operation. In one embodiment, the resilient holding means are a clamp which is generally parallel to the jig arm and the waste material collecting means comprises a magnetic element. The magnetic element is adapted to collect waste material from the knife blade by means of a magnetic attraction arising between the magnetic element and waste material from the knife blade during the sharpening operation.

The above-mentioned jig means may be referred to as a jig, or a knife jig.

According to a second aspect, there is provided a grinding machine. The grinding machine comprises a rotatable grindstone and a support (e.g., a generally cylindrical rod) which is generally parallel to the axis of the grindstone. Jig means according to the first aspect are provided for bringing a knife blade to be sharpened into controlled engagement with the grindstone.

According to this disclosure, the earlier-mentioned object and other objects have been fulfilled inter alia by a jig means for a grinding machine of the above defined type, having a jig arm, which is provided with attachment means for its fixed attachment to the support in a proper position for the sharpening of the knife blade and —at a distance from the attachment means—with resilient holding means for the knife blade.

Preferably, the support is a generally cylindrical rod, whereas the attachment means are a hole in the jig arm and a threaded pin with a knob at the hole.

In a practical embodiment the resilient holding means is a clamp integral with and generally parallel to the jig arm, which may be injection moulded in for example an ABS plastic. Other materials and manufacturing techniques are feasible. The knife blade may easily be inserted sideways into the clamp and be supported by the jig arm area inside the clamp.

The jig arm may be provided with a projection having thereon a scale with desired edge angles for a knife blade to be sharpened.

In order to obtain a desired edge angle at the knife sharpening and a correct position of the jig arm in relation to the grindstone (irrespective of its wear) a template is pivotally attached to the projection and has a pointer towards the scale, means being provided for locking the template to the projection; the template is also provided with two reference pins perpendicular thereto. These two reference pins are to be put in contact with the perimeter of the grindstone for establishing a correct position of the jig arm.

BRIEF DESCRIPTION OF THE DRAWINGS

The invention will be described in further detail below under reference to the accompanying drawings, in which.

DETAILED DESCRIPTION

The present invention will now be described more fully hereinafter. The invention may, however, be embodied in many different forms and should not be construed as limited to the embodiments set forth herein; rather, these embodiments are provided by way of example so that this disclosure will be thorough and complete, and will fully convey the scope of the invention to those persons skilled in the art. Like reference numbers refer to like elements throughout the description.

As will be further detailed herein, this disclosure proposes a knife jig, or jig means, for a grinding machine. The jig means are suitable for bringing a knife blade to be sharpened into controlled engagement with a grindstone of a grinding machine. The grinding machine may be of a type comprising a rotatable grindstone and a support, wherein the support is positioned generally in parallel to a rotational axis of the grindstone. The jig means comprises a jig arm which is provided with attachment means for its fixed attachment to the support in a proper position for the sharpening of the knife blade. Also, at a distance from the attachment means, the jig arm is further provided with resilient holding means for the knife blade, i.e. resilient holding means for releasably holding the knife blade.

An advantage with the knife jig, or jig means, is that a knife blade can be easily mounted in the knife jig. Also, the position of the knife jig in relation to the grindstone may still be controllable. Still further, the use the knife jig is relatively simple. Moreover, the construction of the knife jig is simple and, thus, also relatively inexpensive.

A first embodiment of a knife jig, or jig means, will now be described in detail with reference to FIGS. 1-4.

Figure 1:
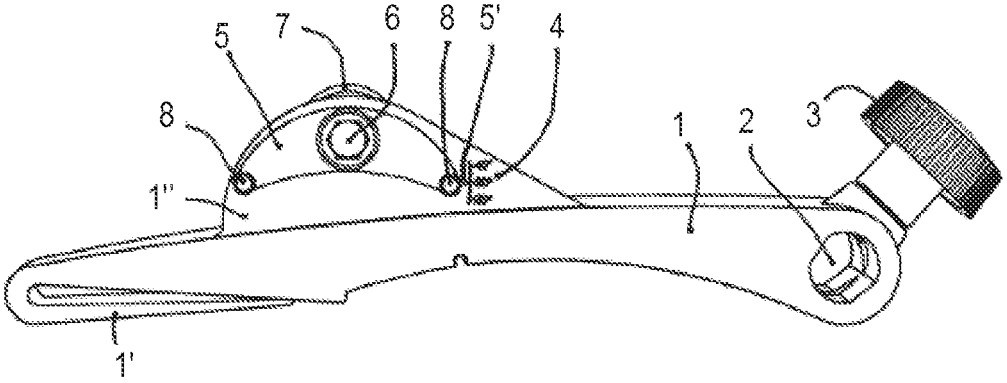
FIG. 1 is a side view of a first embodiment of a knife jig according to the invention.

A knife jig, or jig means, according to a first embodiment of the invention is shown in a side view in FIG. 1. Generally speaking, the knife jig, or jig means, is generally intended for use as described below with a grinding machine provided with an adjustable support, preferably in the form of a rod, called a universal support.

With continued reference to FIG. 1, the main portion of the knife jig is a jig arm, e.g. an elongated jig arm 1. This arm 1 is towards one of its ends (to the right end in FIG. 1) provided with a through hole 2, by which the arm 1 may be mounted on a universal support 12 to be described. A separate knob 3 with a threaded pin is received in a threaded bore at the hole 2, so that the arm 1 may be fastened to the universal support 12 in any desired position. In other words, the separate knob 3 with the threaded pin is located at a position near the hole 2. The hole 2 and the knob 3 together form attachment means for fixed attachment of the jig arm 1 to the support 12. Towards its other end, the arm 1 is provided with a holding means in the form of a preferably integral, resilient clamp 1' for holding a knife in the jig as described below.

The arm 1 may also be provided with an integral projection 1", having thereon a scale 4 with desired edge angles for the knife to be sharpened (for example 20°, 30°, 40°). A template 5 may be pivotally attached to the projection 1" around an axis 6 and may be fixed to the projection 1" in a desired position by a knob 7. The template 5 may have a pointer 5' towards the scale 4 for visually indicating the desired position thereof. The template 5 may also have two reference pins 8 perpendicular thereto. These pins 8 are more clearly shown in FIG. 2.

The arm 1 with its clamp 1'and its projection 1" may, for example, be injection molded in a plastic material, for example an ABS plastic, having the necessary strength and flexibility. Other materials and manufacturing techniques may, however, be equally feasible.

Figure 2:
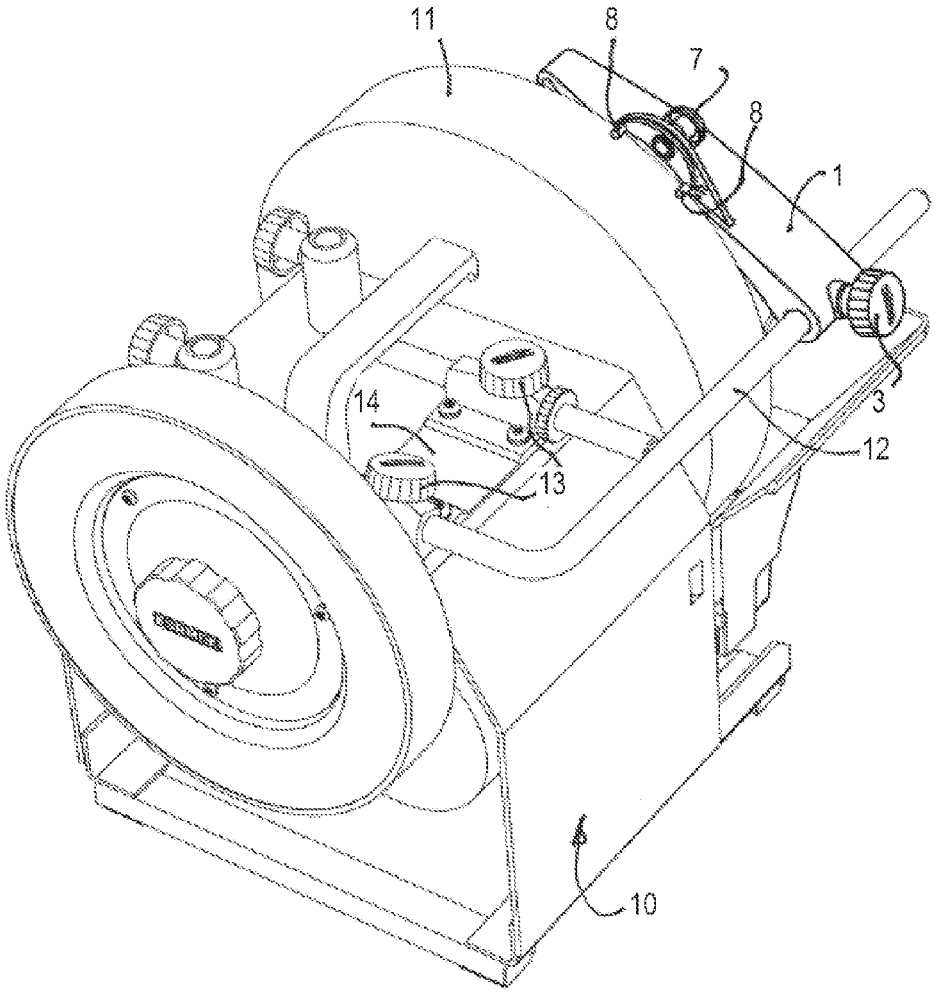
FIG. 2 is an isometric view of a grinding machine with a knife jig shown in FIG. 1 in a second use step.

Referring to FIG. 2, a grinding machine 10 with a grindstone 11, rotatable around its axis (i.e., its rotational axis) by an electric motor in the grinding machine 10, is provided with a support, preferably in the form of a generally cylindrical rod 12, called a universal support. The rod 12 is generally parallel with the axis of the grindstone 11, and its position in relation to the grindstone 11 may be adjusted after loosening adjustment knobs 13 in a bracket 14 on the machine.

A first step in the use of the knife jig for sharpening a knife is to pivot the template 5, so that its pointer 5' points to the desired edge angle, whereafter the knob 7 is tightened.

A second step is schematically illustrated in FIG. 2. The arm 1 is placed with its hole 2 on the support rod 12 at the side of the grindstone 11. The position of the rod 12 in relation to the grindstone 11 is adjusted, such that both reference pins 8 are in contact with the grindstone 11. The adjustment knobs 13 are tightened. This adjustment has the purpose of placing the arm 1 in a correct (or, accurate) position in relation to the grindstone, irrespective of the diameter of the latter.

Figure 3:
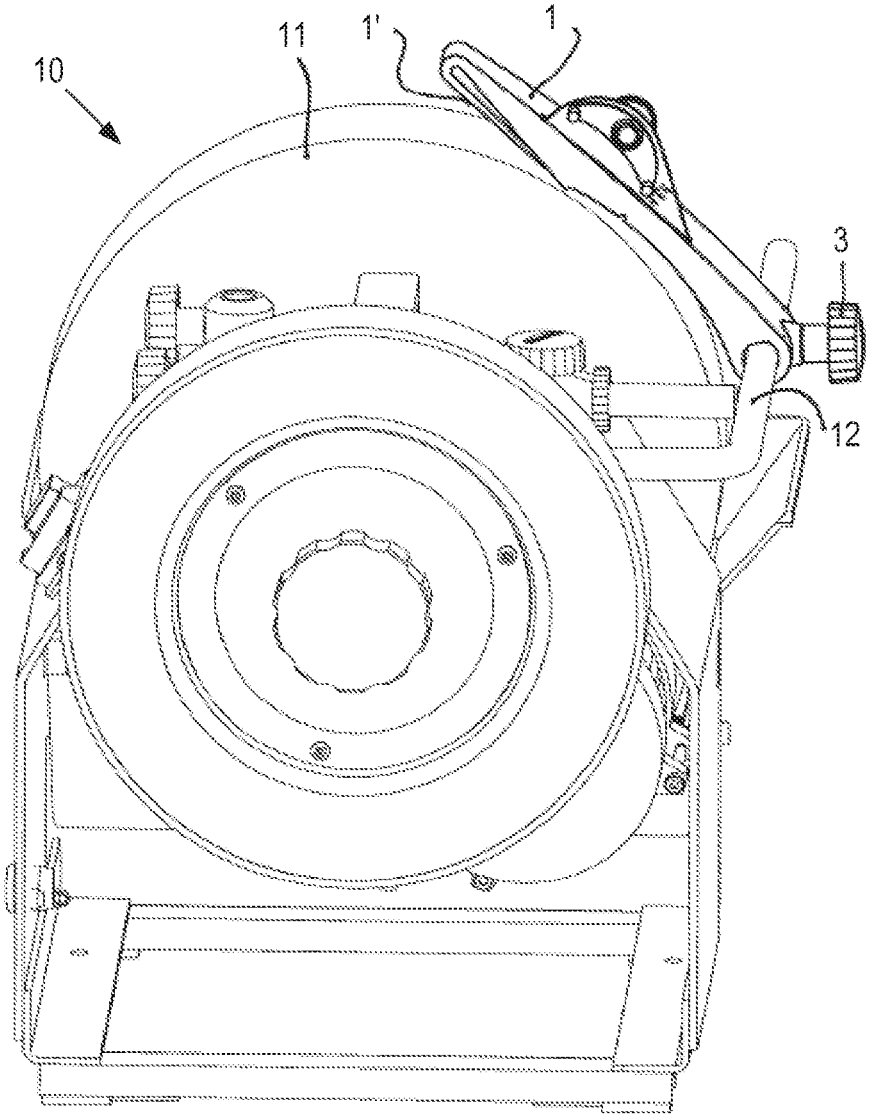
FIG. 3 is a different isometric view of the grinding machine with the knife jig in a third use step.

A third step is schematically illustrated in FIG. 3. The arm 1 is placed tangentially to and closely over the grindstone 11, and the knob 3 is tightened, so that the jig arm 1 is fixed in the desired position on the universal support 12.

Figure 4:
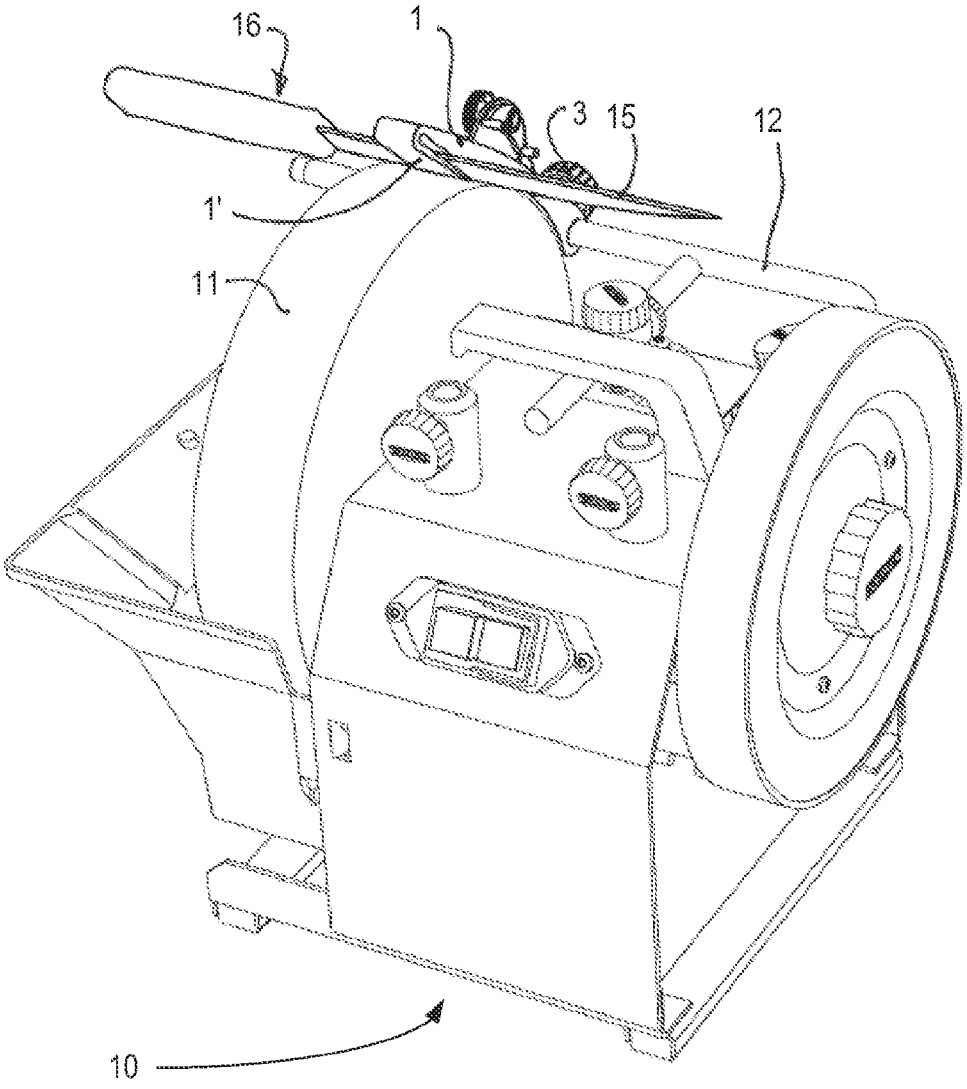
FIG. 4 is another different isometric view of the grinding machine with the knife jig—now provided with a knife—in a fourth use step.

A fourth step—the grinding step itself—is schematically illustrated in FIG. 4. After starting the motor of the grinding machine, the grindstone 11 rotates. The blade 15 of a knife 16 is pushed into the clamp 1' of the arm 1, preferably in the upper, open part thereof, and is brought down towards the grindstone. The knife is steadily but resiliently held therein, even if its blade is as thin as 2 mm. The edge of the knife blade 15 is manually brought into contact with the grindstone 11, and the knife 15 is moved back and forth transverse over the grindstone 11 for grinding the entire blade 15. The process can be repeated for the opposite side of the blade with the knife turned 180°.

Figure 5:
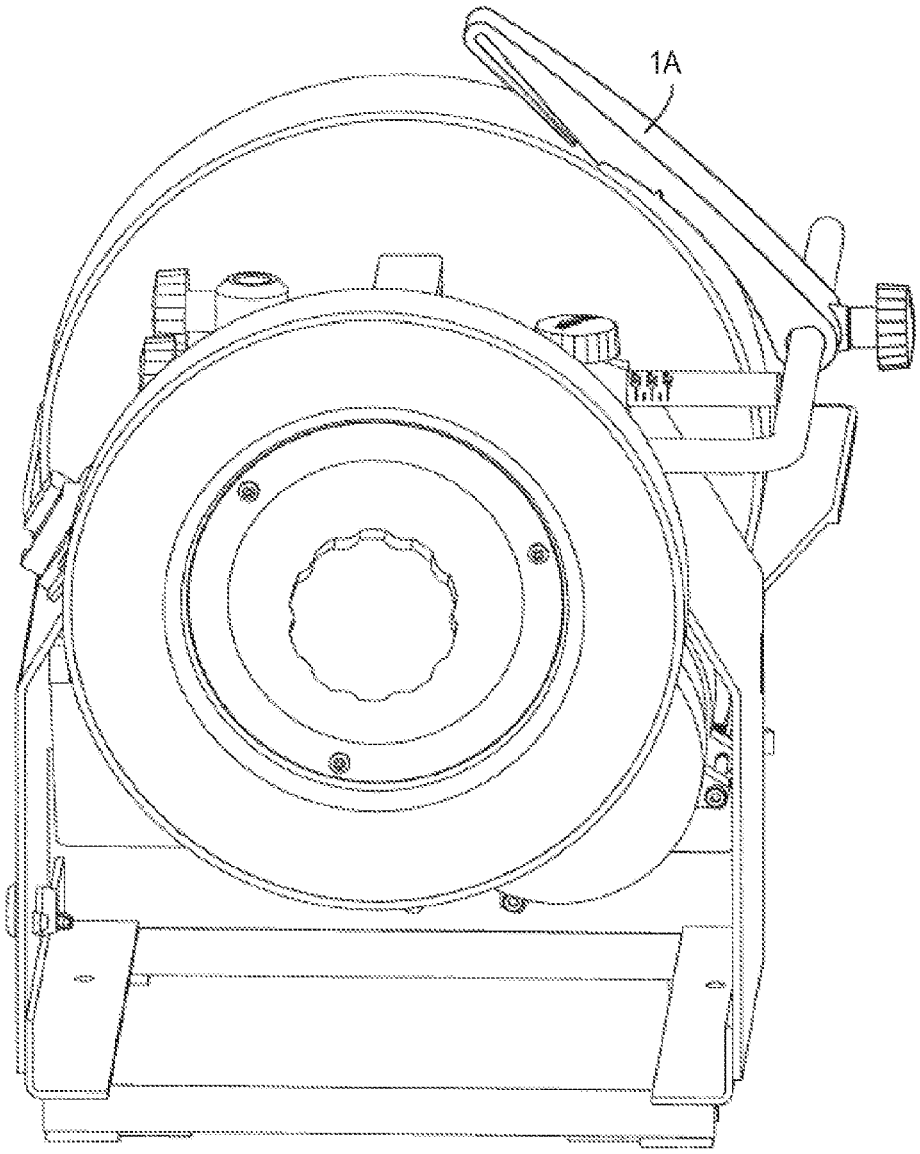
FIG. 5 is an isometric view of a grinding machine with a second embodiment of a knife jig according to the invention.

FIG. 5 illustrates a grinding machine with a second embodiment of a knife jig according to the invention.

In a grinding machine 10, its grindstone 11 is normally of a material subject to wear, which leads to a gradually reduced grindstone diameter, until a new grindstone with the original diameter is fitted. This diameter variation generally leads to the necessity of providing the first embodiment of the jig means with the described adjustment means 1", 4-8.

The grinding machine shown in FIG. 5 is provided with a grindstone of diamond material and thus maintains its diameter practically unchanged. There is accordingly no need to provide the jig arm 1A with any adjustment means as required in the first embodiment illustrated in FIGS. 1-4.

Figure 6:
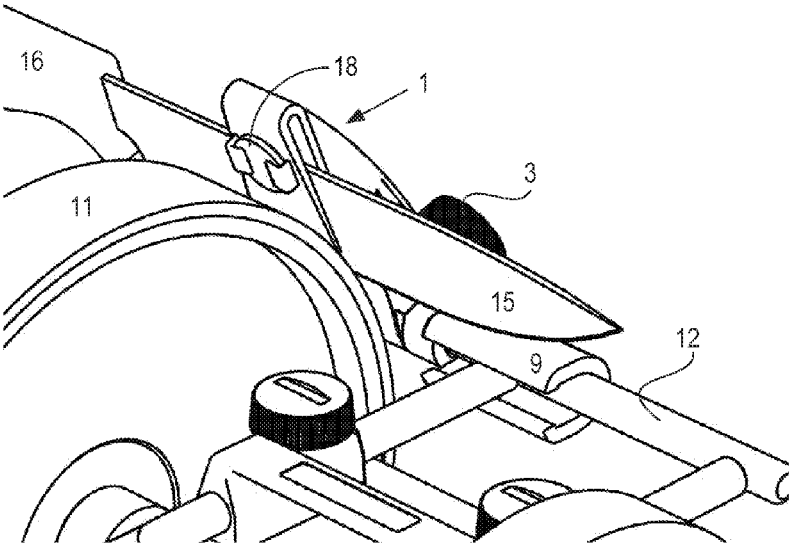
FIGS. 6-8 illustrate views of a third embodiment of a knife jig according to the invention.
Figure 7:
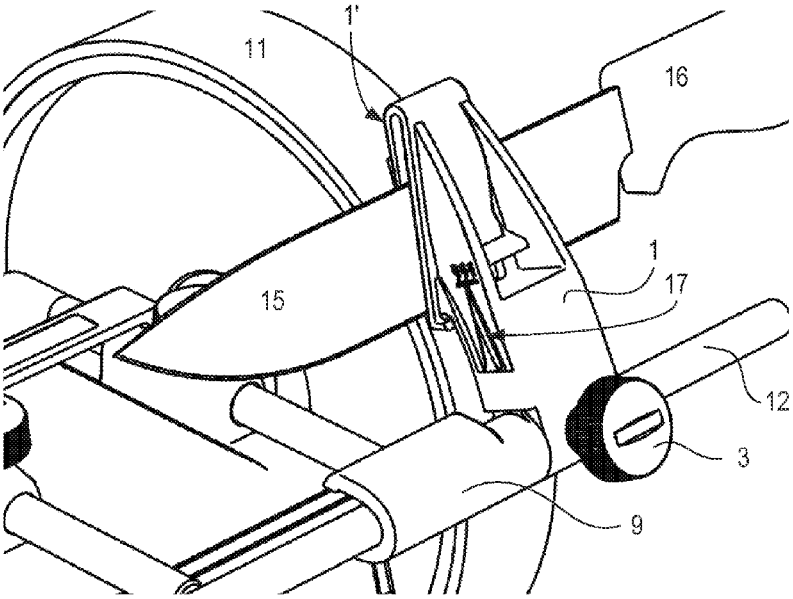
Figure 8:
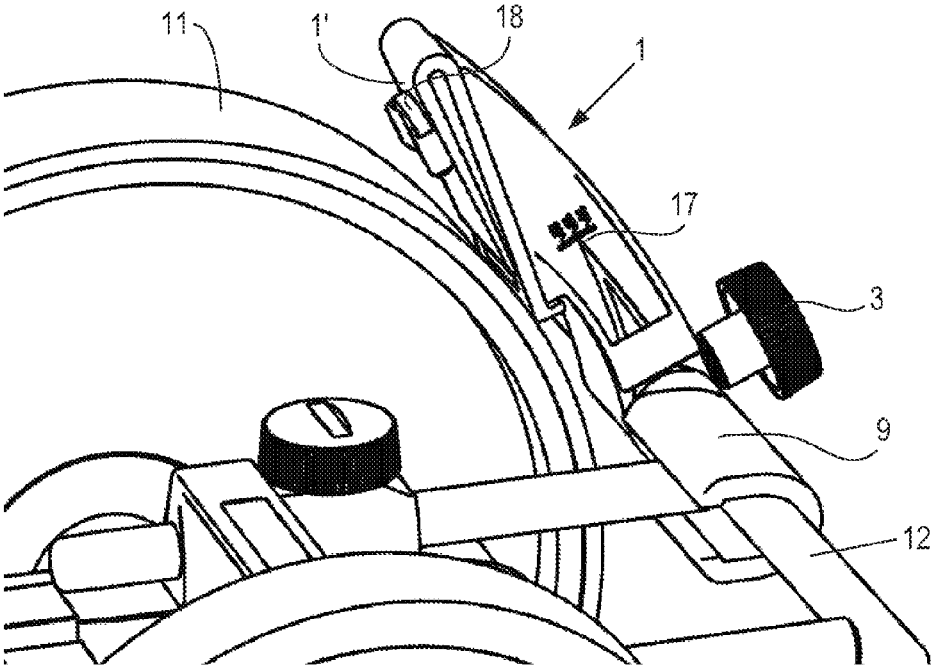

FIGS. 6-8 illustrate different views of a third embodiment of the invention. In this embodiment, the resilient holding means is a clamp 1' which is generally parallel to the jig arm 1. In this embodiment, the clamp 1' and the jig arm 1 are made of different materials. For example, the clamp 1' is made of a first material, which is a resilient material. The resilient material may e.g. be an ABS plastic. The jig arm 1 is made of a second material, which is different from the first material. Typically, but not necessarily, the second material is a metal, or a metal alloy. For example, the jig arm 1 may be made of Zinc, Aluminum, steel, brass or cast iron to name a few examples. Furthermore, it should be appreciated that the metal may be moulded.

The provision of a clamp made of resilient material and a jig arm made of a metal may allow for certain advantages. The resilient material of the clamp 1' allows for the knife blade to be easily inserted sideways into the clamp in such way that the knife blade can be supported by the clamp area inside the clamp. At the same time, the provision of a jig arm which is made of a metal or metal alloy may allow for increased stability when the jig means are attached to the support 12 of the grinding machine 10. This may be particularly advantageous e.g. in order to counter-act any potential vibrations caused by the motor of the grinding machine 10 when the grinding machine 10 is in operation.

As can be seen in FIGS. 7-8, the jig arm 1 may optionally be provided with a scale 17 with desired edge angles for a knife blade 15 to be sharpened. The scale 17 may facilitate the positioning of the jig means at the support 12 thereby assisting a user to achieve a desired result with regard to the evenness and accuracy of the sharpening of the knife blade 15.

With continued reference to FIGS. 6-8, it can be seen that the attachment means 2,3 may additionally comprise a projection 9, which is adapted to at least partly surround and generally abut against the support, i.e. the cylindrical rod 12 in this example. This may allow for even better stability. This feature may be particularly advantageous e.g. in order to counter-act any potential vibrations caused by the motor of the grinding machine 10 when the grinding machine 10 is in operation.

In some advantageous embodiments, the resilient holding means 1' also comprises a waste material collecting means 18 adapted to collect waste material from the knife blade 15 during a sharpening operation. In one embodiment, which is best illustrated in FIGS. 6 and 8, the resilient holding means are a clamp 1' which is generally parallel to the jig arm 1 and the waste material collecting means 18 is a magnetic element. The magnetic element 18 is adapted to collect waste material from the knife blade 15 by means of a magnetic attraction arising between the magnetic element 18 and any waste material resulting from the sharpened knife blade 15 during a sharpening operation. The provision of a waste material collecting means 18 may facilitate for the user to keep the grinding machine 10 clean. Also, an area surrounding the grinding machine 10 may be kept cleaner.

The various embodiments described in this disclosure provide a jig, or jig means, in which a knife blade can be easily mounted. At same time, the position of the jig in relation to the grindstone can still be controllable. In contrast to existing jigs, or jig means, the jig means described herein comprises a resilient holding means which allow for easily mounting the knife blade. At the same time, and thanks to the construction of the jig means, it is possible to achieve sufficient stability during a sharpening operation such that a desired result with regard to the evenness and accuracy of the sharpening of the knife blade can be achieved.

Selected Example Embodiments Described Herein

The technology described in this disclosure thus encompasses without limitation the following Numbered Example Embodiments (NEE's):

NEE1. A grinding machine 10 with a rotatable grindstone 11 and with a support 12, which is generally parallel to the axis of the grindstone, jig means 1-8 being provided for bringing a knife blade 15 to be sharpened into controlled engagement with the grindstone 11, characterized by a jig arm, which is provided with attachment means for its fixed attachment to the support 12 in a proper position for the sharpening of the knife blade 15 and—at a distance from the attachment means—with resilient holding means 1' for the knife blade 15.

NEE2. A grinding machine according to NEE1, wherein the support is a generally cylindrical rod 12 and the attachment means are a hole 2 in the jig arm and a threaded pin with a knob 3 at the hole.

NEE3. A grinding machine according to NEE1, wherein the resilient holding means is a clamp 1' integral with and generally parallel to the jig arm 1: 1A.

NEE4. A grinding machine according to NEE1, wherein the jig arm 1 is provided with a projection 1" having thereon a scale 4 with desired edge angles for a knife blade 15 to be sharpened.

NEE5. A grinding machine according to NEE4, wherein a template 5 is pivotally attached to the projection 1" and has a pointer 5' towards the scale 4, means 7 being provided for locking the template to the projection, and wherein the template 5 is provided with two reference pins 8 perpendicular thereto.

NEE6. A jig means 1-8 as defined in any of the preceding NEEs.

NEE7. Jig means 1-8 for bringing a knife blade 15 to be sharpened into controlled engagement with a grindstone 11 of a grinding machine 10, wherein the grinding machine 10 is of a type comprising a rotatable grindstone 11 and a support 12, and wherein the support 12 is generally parallel to an axis of the grindstone 11, the jig means 1-8 being characterized by a jig arm 1; 1A which is provided with attachment means 2, 3 for its fixed attachment to the support 12 in a proper position for the sharpening of the knife blade 15 and—at a distance from the attachment means—further provided with resilient holding means 1' for the knife blade 15.

NEE8. The jig means 1-8 according to NEE7, wherein the attachment means are a hole 2 of the jig arm 1; 1A and a threaded pin with a knob 3 positioned at the hole 2.

NEE9. The jig means 1-8 according to NEE7 or NEE8, wherein the resilient holding means 1' are a clamp 1' integral with and generally parallel to the jig arm (1: 1A).

NEE10. The jig means 1-8 according to NEE9, wherein the jig arm 1: 1A is injection moulded in Acrylonitrile Butadiene Styrene, ABS, plastic.

NEE11. The jig means 1-8 according to any one of the NEE's 7-10, wherein the jig arm 1 is provided with a projection 1" having thereon a scale 4 with desired edge angles for a knife blade 15 to be sharpened.

NEE12. The jig means 1-8 according to NEE11, wherein a template 5 is pivotally attached to the projection 1" and has a pointer 5' towards the scale 4, means 7 being provided for locking the template to the projection, and wherein the template 5 is provided with two reference pins 8 perpendicular thereto.

NEE13. The jig means 1-8 according to NEE7 or NEE8, wherein the resilient holding means 1' are a clamp 1' which is generally parallel to the jig arm 1: 1A, and wherein the clamp 1'is made of a resilient material and the jig arm 1: 1A is made of a metal.

NEE14. The jig means 1-8 according to NEE13, wherein the clamp 1' is made of ABS plastic.

NEE15. The jig means 1-8 according to NEE13 or NEE14, wherein the jig arm 1 is provided with a scale 17 with desired edge angles for a knife blade 15 to be sharpened.

NEE16. The jig means 1-8 according to any one of the NEE's 7-15, wherein the attachment means 2,3 additionally comprises a projection 9 which is adapted to at least partly surround and generally abut against the support 12.

NEE17. The jig means 1-8 according to any one of the NEE's 7-16, wherein the resilient holding means 1' comprises a waste material collecting means 18 adapted to collect waste material from the knife blade 15 during a sharpening operation.

NEE18. The jig means 1-8 according to NEE17, wherein the resilient holding means 1' are a clamp 1' which is generally parallel to the jig arm 1: 1A and wherein the waste material collecting means 18 comprises a magnetic element, the magnetic element being adapted to collect waste material from the knife blade 15 by means of a magnetic attraction arising between the magnetic element and the waste material from the knife blade 15.

NEE19. The jig means 1-8 according to any one of the NEE's 7-18, wherein the jig means are a knife jig.

NEE20. A grinding machine comprising a rotatable grindstone 11 and a support 12 which is generally parallel to an axis of the grindstone, wherein jig means 1-8 according to any one of NEE's 7-20 are provided for bringing a knife blade 15 to be sharpened into controlled engagement with the grindstone 11.

NEE21. A grinding machine according to NEE 20, wherein the support is a generally cylindrical rod 12.

Modifications are possible within the scope of the appended claims. Modifications and other variants of the described embodiments will thus come to mind to one skilled in the art having benefit of the teachings presented in the foregoing description and associated drawings. Therefore, it is also to be understood that the embodiments are not limited to the specific example embodiments described in this disclosure and that modifications and other variants are intended to be included within the scope of this disclosure. Furthermore, although specific terms may be employed herein, they are used in a generic and descriptive sense only and not for purposes of limitation. Therefore, a person skilled in the art would recognize numerous variations to the described embodiments that would still fall within the scope of the appended claims. As used herein, the terms "comprise/comprises" or "include/includes" do not exclude the presence of other elements or steps. Furthermore, although individual features may be included in different claims, these may possibly advantageously be combined, and the inclusion of different claims does not imply that a combination of features is not feasible and/or advantageous. In addition, singular references do not exclude a plurality.

What is claimed is:

1. A knife jig for a grinding machine, wherein the grinding machine has a rotatable grindstone for sharpening a knife blade, the knife jig comprising:

an elongated jig arm with a first end and a second end, and a projection having thereon a scale for indicating a fixed angle;

the first end comprising an attachment mechanism constructed to pivotably couple the elongated jig arm with a support arm of the grinding machine; and the second end forming a resilient clamp comprising a first member extending distally in a direction opposite of the first end of the elongated jig arm and connected at a distal-most end to a second member by a web integrally formed with the first and second members, the second member extending proximally from the web;

wherein the resilient clamp is capable of clamping the knife blade, wherein the jig is constructed for holding the knife blade at the fixed angle and in controlled engagement with the grindstone, and wherein the fixed angle is adjustable, wherein a template is pivotally attached to the projection and has a pointer towards the scale, wherein the elongated jig arm comprises a locking mechanism for locking the template to the projection, and wherein the template comprises two reference pins perpendicular thereto.

2. The knife jig of claim 1, wherein the attachment mechanism comprises a hole-through the elongated jig arm and a threaded pin positioned at the hole.

3. The knife jig of claim 1, wherein the clamp is integral with and generally parallel to the elongated jig arm.

4. The knife jig of claim 3, wherein the jig arm is injection molded Acrylonitrile Butadiene Styrene (ABS) plastic.

5. The knife jig of claim 1, wherein the clamp is generally parallel to the elongated jig arm.

6. The knife jig of claim 5, wherein the clamp is made of ABS plastic.

7. The knife jig of claim 5, wherein the elongated jig arm comprises a scale for indicating the fixed angle.

8. The knife jig of claim 5, wherein the attachment mechanism additionally comprises a projection adapted to at least partly surround and generally abut against the support arm.

9. The knife jig of claim 5, wherein the clamp comprises a waste material collector adapted to collect waste material from the knife blade during a sharpening operation.

10. The knife jig of claim 9, wherein the waste material collector comprises a magnetic element adapted to collect waste material from the knife blade by magnetic attraction arising between the magnetic element and the waste material from the knife blade.

11. The knife jig of claim 5, wherein the elongated jig arm is made of metal.

12. The knife jig of claim 1, wherein when the clamp is not holding a knife, a proximal end of the second member touches the first member.

13. A grinding machine comprising:

a rotatable grindstone for sharpening a knife blade;

a support arm generally parallel to a rotating axis of the grindstone; and a knife jig comprising:

an elongated jig arm with a first end and a second end, and a projection having thereon a scale for indicating a fixed angle, wherein the fixed angle is a selectable fixed angle;

the first end comprising an attachment mechanism comprising a hole through the elongated jig arm and a threaded pin for pivotably coupling the elongated jig arm with the support arm, and the second end forming a resilient clamp comprising a first member extending distally in a direction opposite of the first end of the elongated jig arm and connected at a distal-most end to a second member by a web integrally formed with the first and second members, the second member extending proximally from the web;

wherein the resilient clamp is capable of clamping the knife blade, wherein the knife jig is constructed for holding the knife blade at the selectable fixed angle in controlled engagement with the grindstone, wherein a template is pivotally attached to the projection and has a pointer towards the scale, wherein the elongated jig arm comprises a locking mechanism for locking the template to the projection, and wherein the template comprises two reference pins perpendicular thereto.

14. A knife jig for a grinding machine, wherein the grinding machine has a rotatable grindstone for sharpening a knife blade, the knife jig comprising:

an elongated jig arm with a first end and a second end;

the first end comprising an attachment mechanism constructed to pivotably couple the elongated jig arm with a support arm of the grinding machine; and the second end forming a resilient clamp comprising a first member extending distally in a direction opposite of the first end of the elongated jig arm and connected at a distal-most end to a second member by a web integrally formed with the first and second members, the second member extending proximally from the web;

wherein the resilient clamp is capable of clamping the knife blade, wherein the jig is constructed for holding the knife blade at a fixed angle and in controlled engagement with the grindstone, wherein the fixed angle is adjustable, wherein the clamp is generally parallel to the elongated jig arm, wherein the clamp comprises a waste material collector adapted to collect waste material from the knife blade during a sharpening operation, and wherein the waste material collector comprises a magnetic element adapted to collect waste material from the knife blade by magnetic attraction arising between the magnetic element and the waste material from the knife blade.

15. The knife jig of claim 14, wherein the attachment mechanism comprises a hole-through the elongated jig arm and a threaded pin positioned at the hole.

16. The knife jig of claim 14, wherein the clamp is integral with and generally parallel to the elongated jig arm.

17. The knife jig of claim 16, wherein the jig arm is injection molded Acrylonitrile Butadiene Styrene (ABS) plastic.

18. The knife jig of claim 14, wherein the elongated jig arm is provided with a projection having thereon a scale for indicating the fixed angle.

19. The knife jig of claim 18, wherein a template is pivotally attached to the projection and has a pointer towards the scale, wherein the elongated jig arm comprises a locking mechanism for locking the template to the projection, and wherein the template comprises two reference pins perpendicular thereto.

20. The knife jig of claim 14, wherein the clamp is made of ABS plastic.

* * * * *